US011316272B2

(12) United States Patent
Park et al.

(10) Patent No.: US 11,316,272 B2
(45) Date of Patent: Apr. 26, 2022

(54) ANTENNA APPARATUS

(71) Applicants: Samsung Electro-Mechanics Co., Ltd., Suwon-si (KR); Seoul National University R&DB Foundation, Seoul (KR)

(72) Inventors: Ju Hyoung Park, Suwon-si (KR); In Seop Yoon, Incheon (KR); Jung Suek Oh, Seoul (KR); Jeong Ki Ryoo, Suwon-si (KR); Kyu Bum Han, Suwon-si (KR)

(73) Assignees: Samsung Electro-Mechanics Co., Ltd., Suwon-si (KR); SEOUL NATIONAL UNIVERSITY R&BD FOUNDATION, Seoul (KR)

( * ) Notice: Subject to any disclaimer, the term of this patent is extended or adjusted under 35 U.S.C. 154(b) by 80 days.

(21) Appl. No.: 16/737,063

(22) Filed: Jan. 8, 2020

(65) Prior Publication Data

US 2020/0411991 A1 Dec. 31, 2020

(30) Foreign Application Priority Data

Jun. 26, 2019 (KR) ..... 10-2019-0076304

(51) Int. Cl.
*H01Q 1/48* (2006.01)
*H01Q 9/04* (2006.01)
(Continued)

(52) U.S. Cl.
CPC ..... *H01Q 9/045* (2013.01); *H01Q 9/0414* (2013.01); *H01Q 21/0025* (2013.01); *H01Q 21/065* (2013.01)

(58) Field of Classification Search
CPC .. H01Q 9/045; H01Q 9/0414; H01Q 21/0025; H01Q 21/065
See application file for complete search history.

(56) References Cited

U.S. PATENT DOCUMENTS 7,425,924 B2 9/2008 Chung et al.
9,614,571 B2 4/2017 Harper
(Continued)

FOREIGN PATENT DOCUMENTS

KR 10-2013-0068782 A 6/2013
KR 10-2018-0105833 A 10/2018

OTHER PUBLICATIONS

Ta et al., "Broadband Printed-Dipole Antenna and Its Arrays for 5G Applications," IEEE Antennas and Wireless Propagation Letters, vol. 16, 2017, pp. 2183-2186.
(Continued)

*Primary Examiner* — Dieu Hien T Duong
(74) *Attorney, Agent, or Firm* — NSIP Law

(57) ABSTRACT

An antenna apparatus includes a feed line; a ground plane surrounding a portion of the feed line; a feed via electrically connected to the feed line and extending from a first side of the feed line; a first end-fire antenna pattern disposed on a first side of at least a portion of the ground plane and spaced apart from the ground plane, and electrically connected to the feed via; a second end-fire antenna pattern disposed on a second side of the feed line opposite the first side of the feed line and spaced apart from the first end-fire antenna pattern; and a core via electrically connecting the first end-fire antenna patterns to the second end-fire antenna pattern.

20 Claims, 13 Drawing Sheets

(51) Int. Cl.
*H01Q 21/00* (2006.01)
*H01Q 21/06* (2006.01)

(56) References Cited

U.S. PATENT DOCUMENTS

2014/0361946 A1* 12/2014 Ganchrow ..... H01Q 19/30
343/795
2015/0303550 A1* 10/2015 Su ..... H01Q 7/00
343/702

OTHER PUBLICATIONS

Hwang et al., "Vertically Stacked Folded Dipole Antenna using Multi-Layer for mm-Wave Mobile Terminals," 2017 IEEE International Symposium on Antennas and Propagation & USNC/URSI National Radio Science Meeting, San Diego, CA, U.S.A., 2017, pp. 2579-2580.

* cited by examiner

ANTENNA APPARATUS

CROSS-REFERENCE TO RELATED APPLICATION(S)

This application claims the benefit under 35 USC 119(a) of Korean Patent Application No. 10-2019-0076304 filed on Jun. 26, 2019 in the Korean Intellectual Property Office, the entire disclosure of which is incorporated herein by reference for all purposes.

BACKGROUND

1. Field

The following description relates to an antenna apparatus.

2. Description of Background

Mobile communications data traffic has increased on an annual basis. Various techniques have been developed to support the rapid increase in data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images at a user viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

A radio frequency (RF) signal of a high frequency band (e.g., 24 GHz, 28 GHz, 36 GHz, 39 GHz, 60 GHz, and the like) may easily be absorbed and lost during transmission, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and a radio frequency integrated circuit (RFIC), effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An antenna apparatus which may provide a transmission and reception configuration for a plurality of different frequency bands, may improve an antenna performance, and/or may be easily miniaturized.

In one general aspect, an antenna apparatus includes: a feed line; a ground plane surrounding a portion of the feed line; a feed via electrically connected to the feed line and extending from a first side of the feed line; a first end-fire antenna pattern disposed on a first side of at least a portion of the ground plane and spaced apart from the ground plane, and electrically connected to the feed via; a second end-fire antenna pattern disposed on a second side of the feed line opposite the first side of the feed line and spaced apart from the first end-fire antenna pattern; and a core via electrically connecting the first end-fire antenna patterns to the second end-fire antenna pattern.

The core via may include a plurality of core vias, and the second end-fire antenna pattern may electrically connect the plurality of core vias to each other.

The antenna apparatus may include a core pattern electrically connected to the core via between the first end-fire antenna pattern and the second end-fire antenna pattern and having a width greater than a width of the core via.

The antenna apparatus may include a plurality of first ground patterns extending from at least a portion of the ground plane such that the first end-fire antenna pattern and the second end-fire antenna pattern are disposed between the plurality of first ground patterns and the ground plane, and the plurality of first ground patterns may include first protruding portions protruding towards each other.

The core via may be disposed more adjacent to the plurality of first ground patterns than to the feed via.

The antenna apparatus may include: a plurality of second ground patterns disposed on a first side of the plurality of first ground patterns and including second protruding portions protruding towards each other; and a plurality of first shielding vias electrically connecting the first protruding portions to the second protruding portions.

The first end-fire antenna pattern may extend diagonally with respect to the feed line.

A deviation of a width of the second end-fire antenna pattern may be greater than a deviation of a width of the first end-fire antenna pattern.

A spacing distance between the feed line and the second end-fire antenna pattern may be larger than a spacing distance between the feed line and the first end-fire antenna pattern.

The antenna apparatus may include a patch antenna pattern disposed on the second side of the feed line farther away from the feed line than the ground plane, and at least a portion of the second end-fire antenna pattern may be disposed at a same distance or farther away from the feed line than the patch antenna pattern.

In another general aspect, an antenna apparatus includes a feed line; a ground plane surrounding at least a portion of the feed line; a first end-fire antenna pattern disposed on a first side of the ground plane, spaced apart from the ground plane, and electrically connected to the feed line; a second end-fire antenna pattern disposed on an opposite side of the feed line from the first end-fire antenna pattern and spaced apart from the first end-fire antenna pattern; and a core via electrically connecting the first end-fire antenna pattern to the second end-fire antenna pattern; and a plurality of first ground patterns extending from at least a portion of the ground plane such that the first end-fire antenna pattern and the second end-fire antenna pattern are disposed between the plurality of first ground patterns and the ground plane, and the plurality of first ground patterns includes first protruding portions protruding towards each other.

The antenna apparatus may include: a plurality of second ground patterns disposed on a first side of the plurality of first ground patterns and including second protruding portions protruding towards each other; and a plurality of first shielding vias electrically connecting the first protruding portions to the second protruding portions.

The antenna apparatus may include a plurality of second shielding vias, at least a portion of which is disposed in between the first and second end-fire antenna patterns and the ground plane, and extending from the ground plane away from the feed line.

The first end-fire antenna pattern may be disposed at a same distance or farther away from the feed line than at least a portion of the plurality of first ground patterns, and the second end-fire antenna pattern may be disposed at a same distance or farther away from the feed line than at least a portion of the plurality of second ground patterns.

The first protruding portions may protrude towards each other in a region disposed further away from the first side of the ground plane than the first end-fire antenna pattern and the second end-fire antenna pattern, and a spacing distance between the first protruding portions may be larger than a length of the second end-fire antenna pattern.

Each of the plurality of first ground patterns may be L-shaped or T-shaped.

In another general aspect, an antenna apparatus includes a ground plane extending in a first direction; a feed line extending from the ground plane in a second direction substantially perpendicular to the first direction; a first end-fire antenna pattern electrically connected to the feed line and disposed on a first side of the feed line spaced apart from the feed line in a third direction substantially perpendicular to the first direction and the second direction; a second end-fire antenna pattern disposed on a second side of the feed line opposite the first side of the feed line and spaced apart from the feed line in the third direction; a core via spaced apart from the feed line in the first direction and the second direction and electrically connecting the first end-fire antenna pattern to the second end-fire antenna pattern; and a ground pattern including a first portion that extends from the ground plane in the second direction and a second portion that extends from the first portion in the first direction.

The second portion of the ground pattern may be spaced apart from the ground plane in the second direction more than both the first end-fire antenna pattern and the second end-fire antenna pattern.

A point at which the first end-fire antenna pattern is electrically connected to the feed line may be spaced apart from the ground plane in the second direction more than the core via.

The core via may be spaced apart from the ground plane in the second direction more than a point at which the first end-fire antenna pattern is electrically connected to the feed line.

Other features and aspects will be apparent from the following detailed description, the drawings, and the claims.

BRIEF DESCRIPTION OF DRAWINGS

FIG. 10 is a plan view illustrating an antenna apparatus according to an example.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
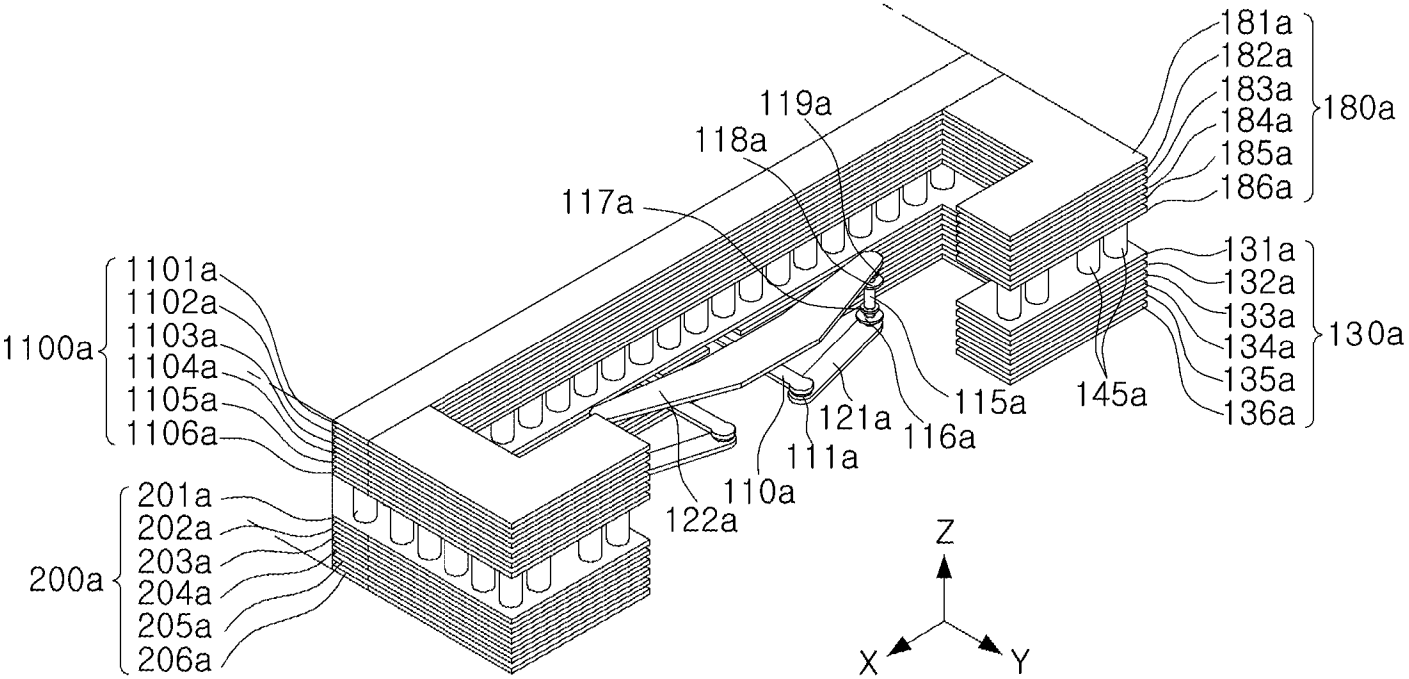
FIG. 1A is a perspective view illustrating an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Hereinafter, examples of the present disclosure will be described as follows with reference to the attached drawings.

Figure 1B:
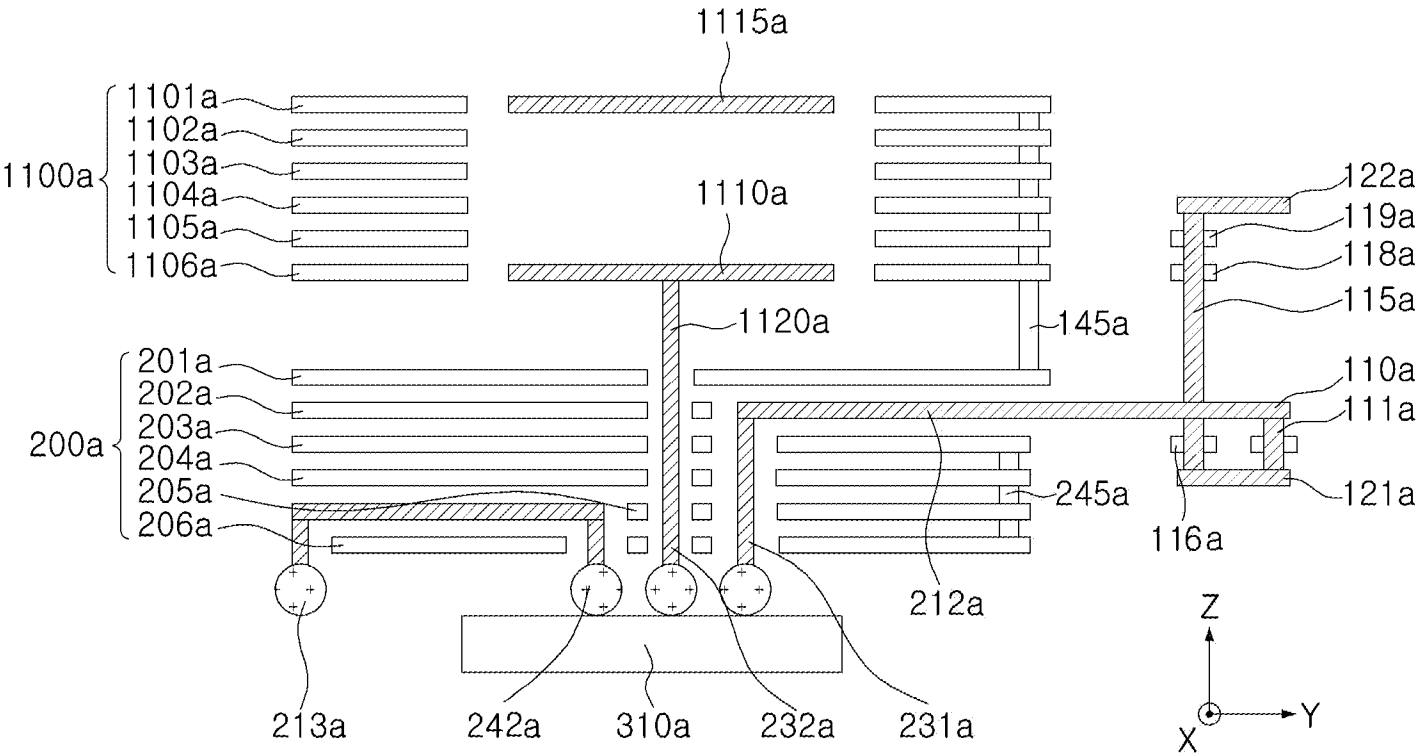
FIG. 1B is a side view illustrating an antenna apparatus according to an example.

FIG. 1A is a perspective view illustrating an antenna apparatus according to an example. FIG. 1B is a side view illustrating an antenna apparatus according to an example. FIG. 10 is a plan view illustrating an antenna apparatus according to an example.

Figure 1C:
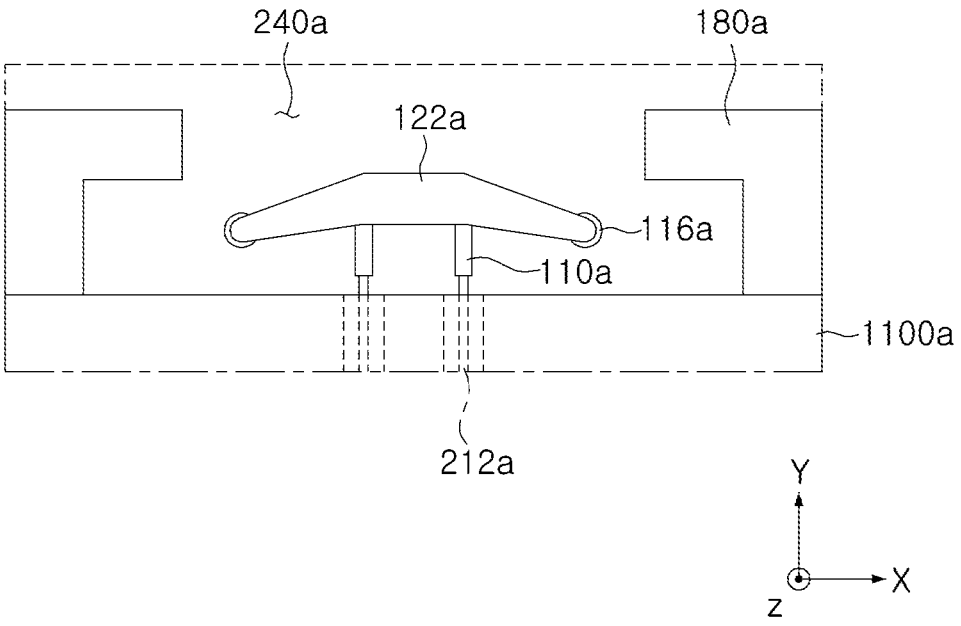

Referring to FIGS. 1A, 1B, and 1C, an antenna device may include a first end-fire antenna pattern 121*a* and a second end-fire antenna pattern 122*a*, and accordingly, the antenna device may provide a transmission and reception configuration for a plurality of different frequency bands.

The first end-fire antenna pattern 121*a* may be electrically connected to one end of a feed line 110*a* through a feed via 111*a*, and may be provided with first and second radio frequency signals from the feed line 110*a* and may transmit the RF signals in a front direction (e.g., a Y direction), or may provide first and second RF signals received in a front direction to the feed line 110*a*.

The feed line 110*a* may be electrically connected to a first wiring via 231*a* in a connection member 200*a*, and the first wiring via 231*a* may be electrically connected to an IC 310*a* disposed on a lower side (e.g., in a −z direction). The IC 310*a* may provide the first and second RF signals to the first end-fire antenna pattern 121*a* and the second end-fire antenna pattern 122*a* or may be provided with the first and second RF signals through the first wiring via 231*a* and the feed line 110*a*.

The feed line 110*a* may have a structure in which a transmission path of the first RF signal of a first frequency band (e.g., 39 GHz) and a transmission path of the second RF signal of a second frequency band (e.g., 28 GHz) are shared. Accordingly, the number of the feed line 110*a* may decrease, a size of an area occupied by the RF signal transmission path may decrease in the connection member 200*a*, and an overall size of the antenna device in the example may be reduced.

For example, the feed line 110*a* may include first and second feed lines. The first and second feed lines may be electrically connected to poles on one side and the other side of the first end-fire antenna pattern 121*a*, respectively.

A portion 212*a* of the feed line 110*a* may be surrounded by at least portions of ground planes 201*a*, 202*a*, 203*a*, 204*a*, 205*a*, and 206*a*, which are included in the connection member 200*a*. Accordingly, the first and second end-fire antenna patterns 121*a* and 122*a* may form a radiation pattern around end lines of the ground planes 201*a*, 202*a*, 203*a*, 204*a*, 205*a*, and 206*a*.

The first and second end-fire antenna patterns 121*a* and 122*a* may resonate with respect to the first frequency band and/or the second frequency band, respectively, may receive energy corresponding to the first and second RF signals, and may externally irradiate the energy.

An insulating layer 240*a* may surround the first and second end-fire antenna patterns 121*a* and 122*a*, and may have a dielectric constant (Dk) higher than that of air. The dielectric constant may affect resonance frequencies of the first and second end-fire antenna patterns 121*a* and 122*a*.

The connection member 200*a* may reflect first and second RF signals among the first and second RF signals irradiated by the first and second end-fire antenna patterns 121*a* and 122*a* towards the connection member 200*a*, and accordingly, radiation patterns of the first and second end-fire antenna patterns 121*a* and 122*a* may be focused in a front direction (e.g., a Y direction). Accordingly, gains of the first and second end-fire antenna patterns 121*a* and 122*a* may improve.

At least portions of a plurality of second shielding vias 145*a* may be disposed in rear of the first and second end-fire antenna patterns 121*a* and 122*a* and may extend to an upper side from the ground planes 201*a*, 202*a*, 203*a*, 204*a*, 205*a*, and 206*a*. The plurality of second shielding vias 145*a* may improve a reflection performance of the connection member 200*a* with respect to the first and second RF signals.

Resonance of the first and second end-fire antenna patterns 121*a* and 122*a* may be generated on the basis of a resonance frequency determined by combination of inductance and capacitance corresponding to the first and second end-fire antenna patterns 121*a* and 122*a* and a peripheral structure of the first and second end-fire antenna patterns 121*a* and 122*a*.

Each of the first and second end-fire antenna patterns 121*a* and 122*a* may have a bandwidth based on an intrinsic resonance frequency determined by intrinsic elements (e.g., a form, a size, a thickness, a spacing distance, a dielectric constant of an insulating layer, and the like) and an extrinsic resonance frequency determined by electromagnetic coupling with an adjacent pattern and/or a via.

The first end-fire antenna pattern 121*a* may have a size smaller than a size of the second end-fire antenna pattern 122*a*, and may thus have inductance and/or capacitance less than inductance and/or capacitance determined based on intrinsic elements of the second end-fire antenna pattern 122*a*. Thus, the first end-fire antenna pattern 121*a* may dominantly resonate with respect to the first RF signal having a relatively short wavelength among the first and second RF signals. The second end-fire antenna pattern 122*a* may dominantly resonate with respect to the second RF signal.

The feed via 111*a* may electrically connect the first end-fire antenna pattern 121*a* to the feed line 110*a*. The first end-fire antenna pattern 121*a* may be disposed on a lower side of the feed line 110*a* by the feed via 111*a*.

A vector element taken in −Z direction of the first RF signal of the first end-fire antenna pattern 121*a* may be added to the first RF signal in accordance with provision of a path taken in the −Z direction by the feed via 111*a*. Accordingly, a radiation pattern of the first end-fire antenna pattern 121*a* may be inclined in the −Z direction on a front side (e.g., a Y direction).

A core via 115*a* may electrically connect the first end-fire antenna pattern 121*a* and the second end-fire antenna pattern 122*a* to each other.

The core via 115*a* may have a relatively long length such that the second end-fire antenna pattern 122*a* may be disposed on an upper level (+Z direction) with respect to a level of the feed line 110*a*.

A vector element taken in a +Z direction of the second RF signal of the second end-fire antenna pattern 122*a* may be added to the second RF signal in accordance with provision of a path taken in a +Z direction by the core via 115*a*. Accordingly, a radiation pattern of the second end-fire antenna pattern 122*a* may be inclined in the +Z direction on a front side (e.g., a Y direction).

Accordingly, a radiation pattern of the first end-fire antenna pattern 121*a* may be slightly inclined in the −Z direction, and a radiation pattern of the second end-fire antenna pattern 122*a* may be slightly inclined in the +Z direction.

Accordingly, radiation patterns of the first and second end-fire antenna patterns 121*a* and 122*a* may be spaced apart from each other, thereby reducing electromagnetic interference between the first and second end-fire antenna patterns 121*a* and 122*a* and improving a gain related to the first and second RF signals.

A length of the core via 115*a* may be longer than a length of the feed via 111*a* (in the Z direction), and a length of the feed via 111*a* and a length of the core via 115*a* may work as factors affecting resonance frequencies of the first and second end-fire antenna patterns 121*a* and 122*a*.

A length of the feed via 111*a* may correspond to the first RF signal having a relatively short length among the first and second RF signals, and a length of the core via 115*a* may correspond to the second RF signal having a relatively long wavelength among the first and second RF signals.

As the core via 115*a* is configured to extend from the first end-fire antenna pattern 121*a* disposed on a level lower (in the Z direction) than a level of the feed line 110*a*, a length of the core via 115*a* may easily be elongated.

Accordingly, the first and second end-fire antenna patterns 121*a* and 122*a* may easily add resonance points for the first and second RF signals, respectively, thereby easily widening first and second bandwidths corresponding to first and second frequencies.

Also, due to the structure of the core via 115*a* and the feed via 111*a* extending in different directions, a difference in heights between the first and second end-fire antenna patterns 121*a* and 122*a* may increase.

Thus, points at which radiation patterns of the first and second end-fire antenna patterns 121*a* and 122*a* are formed may be spaced apart from each other, and radiation patterns of the first and second end-fire antenna patterns 121*a* and 122*a* may thus be spaced apart from each other. Accordingly, electromagnetic interference between the first and second end-fire antenna patterns 121*a* and 122*a* may be reduced, and a gain related to the first and second RF signals may improve.

For example, the core via 115*a* may include a plurality of core vias, and the second end-fire antenna pattern 122*a* may electrically connect the plurality of core vias. To this end, the second end-fire antenna pattern 122*a* may be configured as a closed-type, which may be different from the open-type first end-fire antenna pattern 121*a*. As the open-type antenna pattern and the closed-type antenna pattern may form radiation patterns by different electromagnetic principles, electromagnetic interference between first and second radiation patterns of the first and second end-fire antenna patterns 121*a* and 122*a* may be reduced. Accordingly, gains related to the first and second RF signals may improve.

Referring to FIGS. 1A, 1B, and 10, the antenna apparatus may further include core patterns 116*a*, 117*a*, 118*a*, and 119*a* electrically connected to the core via 115*a* between the first and second end-fire antenna patterns 121*a* and 122*a* and each having a width (in the X and Y directions) greater than a width of the core via 115*a*.

A width of each of the core patterns 116*a*, 117*a*, 118*a*, and 119*a* taken in a horizontal direction (e.g., an X direction and/or a Y direction) may work as a factor affecting resonance frequencies of the first and second end-fire antenna patterns 121*a* and 122*a*.

For example, when a width of each of the core patterns 116*a*, 117*a*, 118*a*, and 119*a* taken in a horizontal direction is optimized to one of the first and second resonance frequencies of the first and second end-fire antenna patterns 121*a* and 122*a*, a width of each of the core patterns 116*a*, 117*a*, 118*a*, and 119*a* taken in a horizontal direction may work as a filtering element for the other one of the first and second resonance frequencies.

Accordingly, the core patterns 116*a*, 117*a*, 118*a*, and 119*a* may increase electromagnetic isolation between the first and second end-fire antenna patterns 121*a* and 122*a*.

Also, the core patterns 116*a*, 117*a*, 118*a*, and 119*a* may be electromagnetically coupled to a plurality of first ground patterns 131*a*, 132*a*, 133*a*, 134*a*, 135*a*, and 136*a* (collectively 130*a*), and the electromagnetic coupling of the core patterns 116*a*, 117*a*, 118*a*, and 119*a* may work as a factor affecting resonance frequencies of the first and second end-fire antenna patterns 121*a* and 122*a*.

Referring to FIGS. 1A, 1B, and 10, the antenna apparatus may further include the plurality of first ground patterns 131*a*, 132*a*, 133*a*, 134*a*, 135*a*, and 136*a*, a plurality of second ground patterns 181*a*, 182*a*, 183*a*, 184*a*, 185*a* and 186*a* (collectively second ground patterns 180*a*), a plurality of first shielding vias 145*a*, and the second shielding vias 245*a*.

The plurality of first ground patterns 131*a*, 132*a*, 133*a*, 134*a*, 135*a*, and 136*a* may extend from at least portions of the plurality of ground planes 201*a*, 202*a*, 203*a*, 204*a*, 205*a*, and 206*a*, respectively, to be disposed between the first and second end-fire antenna patterns 121*a* and 122*a*, and may have protruding portions protruding towards each other on front regions of the plurality of ground planes 201*a*, 202*a*, 203*a*, 204*a*, 205*a*, and 206*a*.

For example, each of the plurality of first ground patterns 131*a*, 132*a*, 133*a*, 134*a*, 135*a*, and 136*a* may have an L-shaped form or a T-shaped form.

Accordingly, a first spacing distance taken in the X direction between the protruding portions of the plurality of first ground patterns 131*a*, 132*a*, 133*a*, 134*a*, 135*a*, and 136*a* may be shorter than a second spacing distance taken in the X direction between rear portions of the first ground patterns 131*a*, 132*a*, 133*a*, 134*a*, 135*a*, and 136*a*.

The first and second spacing distances taken in the X direction may work as factors affecting resonance frequencies of the first and second end-fire antenna patterns 121*a* and 122*a*.

Thus, the plurality of first ground patterns 131*a*, 132*a*, 133*a*, 134*a*, 135*a*, and 136*a* may provide impedance corresponding to the first spacing distance taken in the X direction to the first end-fire antenna pattern 121*a*, and may provide impedance corresponding to the second spacing distance taken in the X direction to the second end-fire antenna pattern 122*a*. Accordingly, the first and second end-fire antenna patterns 121*a* and 122*a* may easily improve gains or may easily broaden bandwidths.

The core via 115*a* may be disposed more adjacent to the plurality of first ground patterns 131*a*, 132*a*, 133*a*, 134*a*, 135*a*, and 136*a* than the feed via 111*a*.

Accordingly, the core via 115*a* may be electromagnetically coupled to the protruding portions of the plurality of first ground patterns 131*a*, 132*a*, 133*a*, 134*a*, 135*a*, and 136*a* in an efficient manner.

The plurality of second ground patterns 181*a*, 182*a*, 183*a*, 184*a*, 185*a*, and 186*a* may be disposed on upper portions of the plurality of first ground patterns 131*a*, 132*a*, 133*a*, 134*a*, 135*a*, and 136*a* and may be spaced apart from each other, and may having protruding portions protruding towards each other.

The plurality of first shielding vias 145*a* may electrically connect the protruding portions of the first and second ground patterns 131*a*, 132*a*, 133*a*, 134*a*, 135*a*, 136*a*, 181*a*, 182*a*, 183*a*, 184*a*, 185*a*, and 186*a*. The plurality of first shielding vias 145*a* may be electromagnetically coupled to the core via 115*a*.

The protruding structures of the plurality of second ground patterns 181*a*, 182*a*, 183*a*, 184*a*, 185*a*, and 186*a* may work as factors affecting resonance frequencies of the first and second end-fire antenna patterns 121*a* and 122*a*. Thus, the first and second end-fire antenna patterns 121*a* and 122*a* may easily improve gains or may easily widen bandwidths.

The first end-fire antenna pattern 121*a* may be disposed on a level lower than or at the same level as a level of at least portions of the plurality of first ground patterns 131*a*, 132*a*, 133*a*, 134*a*, 135*a*, and 136*a*. The second end-fire antenna pattern 122*a* may be disposed on a level higher than or at the same level as at least portions of the plurality of second ground patterns 181*a*, 182*a*, 183*a*, 184*a*, 185*a*, and 186*a*.

Accordingly, a spacing distance between the first and second end-fire antenna patterns 121*a* and 122*a* taken in the Z direction may easily be elongated, and electromagnetic interference between the first and second RF signals may be reduced. Also, by including the plurality of first and second ground patterns 131*a*, 132*a*, 133*a*, 134*a*, 135*a*, 136*a*, 181*a*, 182*a*, 183*a*, 184*a*, 185*a*, and 186*a*, an overall size of the antenna apparatus may not substantially increase even when a spacing distance between the first and second end-fire antenna patterns 121*a* and 122*a* in the Z direction increases.

The first and second ground patterns 131*a*, 132*a*, 133*a*, 134*a*, 135*a*, 136*a*, 181*a*, 182*a*, 183*a*, 184*a*, 185*a*, and 186*a* may protrude more forward than the first and second end-fire antenna patterns 121*a* and 122*a*, and may protrude by lengths at which the protruding portions do not block at least portions of the front regions of the first and second end-fire antenna patterns 121*a* and 122*a*.

Accordingly, a shortest spacing distance between a portion and the other portion of each of the first and second ground patterns 131*a*, 132*a*, 133*a*, 134*a*, 135*a*, 136*a*, 181*a*, 182*a*, 183*a*, 184*a*, 185*a*, and 186*a* may be greater than a length of the second end-fire antenna pattern 122*a*.

Accordingly, the protruding portions of the first and second ground patterns 131*a*, 132*a*, 133*a*, 134*a*, 135*a*, 136*a*, 181*a*, 182*a*, 183*a*, 184*a*, 185*a*, and 186*a* may not substantially interfere with formation of radiation patterns of the first and second end-fire antenna patterns 121*a* and 122*a*, and thus, the first and second end-fire antenna patterns 121*a* and 122*a* may secure relatively high gains.

Referring to FIG. 1B, the antenna apparatus may further include a patch antenna pattern 1110*a* disposed on a level higher than levels of the plurality of ground planes 201*a*, 202*a*, 203*a*, 204*a*, 205*a*, and 206*a*.

The patch antenna pattern 1110*a* may be electrically connected to a second feed via 1120*a* and may remotely transmit and receive a third RF signal in the Z direction, and may be electromagnetically coupled to an upper coupling pattern 1115*a*, thereby widening a bandwidth. The patch antenna pattern 1110*a* may be surrounded by a plurality of patch antenna ground patterns 1101*a*, 1102*a*, 1103*a*, 1104*a*, 1105*a*, and 1106*a* (collectively patch antenna ground patterns 1100*a*).

The plurality of patch antenna ground patterns 1101*a*, 1102*a*, 1103*a*, 1104*a*, 1105*a*, and 1106*a* may be electrically connected to the plurality of second ground patterns 181*a*, 182*a*, 183*a*, 184*a*, 185*a*, and 186*a*.

The second feed via 1120*a* may be electrically connected to a second wiring via 232*a*. The first and second wiring vias 231*a* and 232*a* may be electrically connected to an IC 310*a* through an electrical interconnect structure 242*a*. The IC 310*a* may receive or transmit a base signal (e.g., an IF signal or a baseband signal) through a mount electrical interconnect structure 213*a*.

At least a portion of the second end-fire antenna pattern 122*a* may be disposed on a level higher than or at the same level as a level of the patch antenna pattern 1110*a*. Accordingly, a spacing distance between the first and second end-fire antenna patterns 121*a* and 122*a* taken in the Z direction may easily be elongated, thereby reducing electromagnetic interference between the first and second RF signals.

Referring to FIGS. 1A through 10, the connection member 200*a* may have a structure in which the plurality of ground planes 201*a*, 202*a*, 203*a*, 204*a*, 205*a*, and 206*a* are stacked. The number of the plurality of ground planes 201*a*, 202*a*, 203*a*, 204*a*, 205*a*, and 206*a* is not limited to any particular number.

At least one of the plurality of ground planes 201*a*, 202*a*, 203*a*, 204*a*, 205*a*, and 206*a* may surround a portion 212*a* of the feed line 110*a*, and may be disposed on rear regions of the first and second end-fire antenna patterns 121*a* and 122*a*. Accordingly, the plurality of ground planes 201*a*, 202*a*, 203*a*, 204*a*, 205*a*, and 206*a* may reflect the first and second RF signals radiated from the first and second end-fire antenna patterns 121*a* and 122*a*. Thus, the plurality of ground planes 201*a*, 202*a*, 203*a*, 204*a*, 205*a*, and 206*a* may work as reflectors in relation to the first and second end-fire antenna patterns 121*a* and 122*a*, thereby improving gains of the first and second end-fire antenna patterns 121*a* and 122*a*.

Figure 2A:
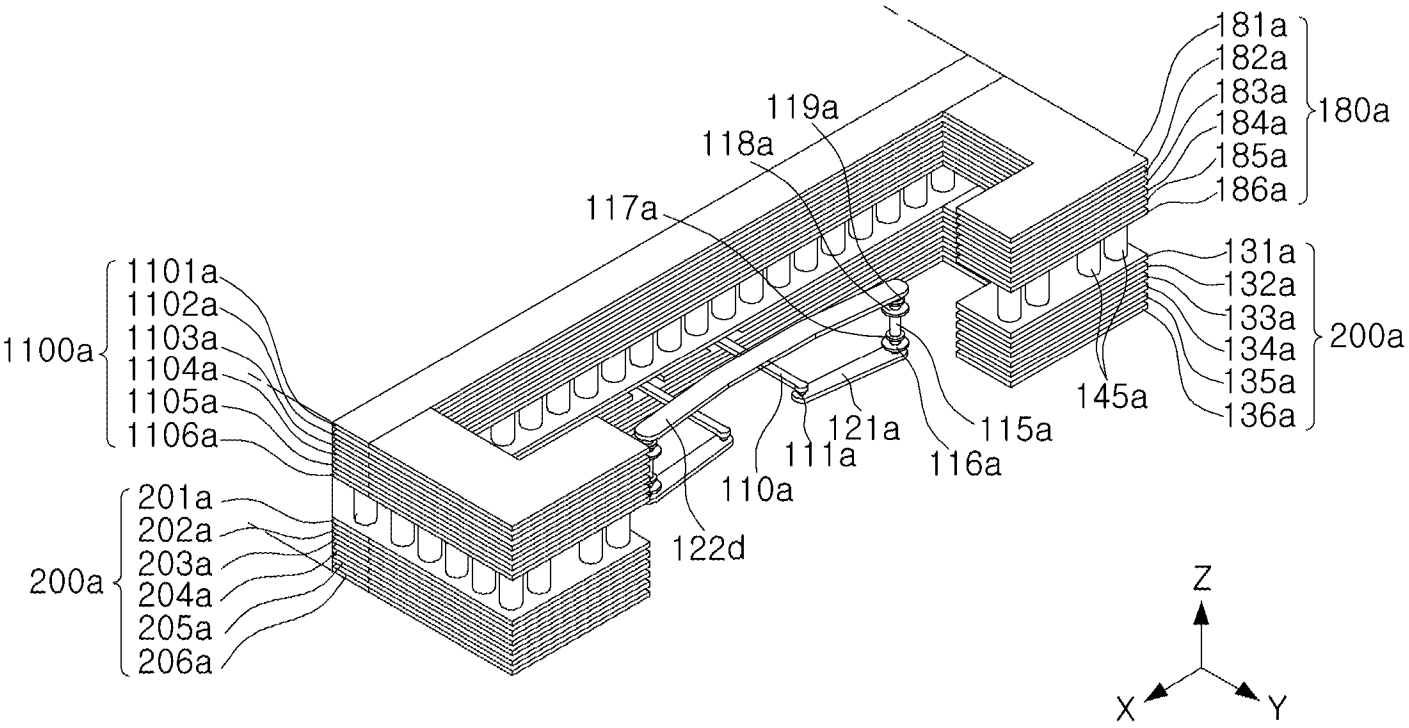
FIG. 2A is a perspective view illustrating an antenna apparatus according to an example.
Figure 2B:
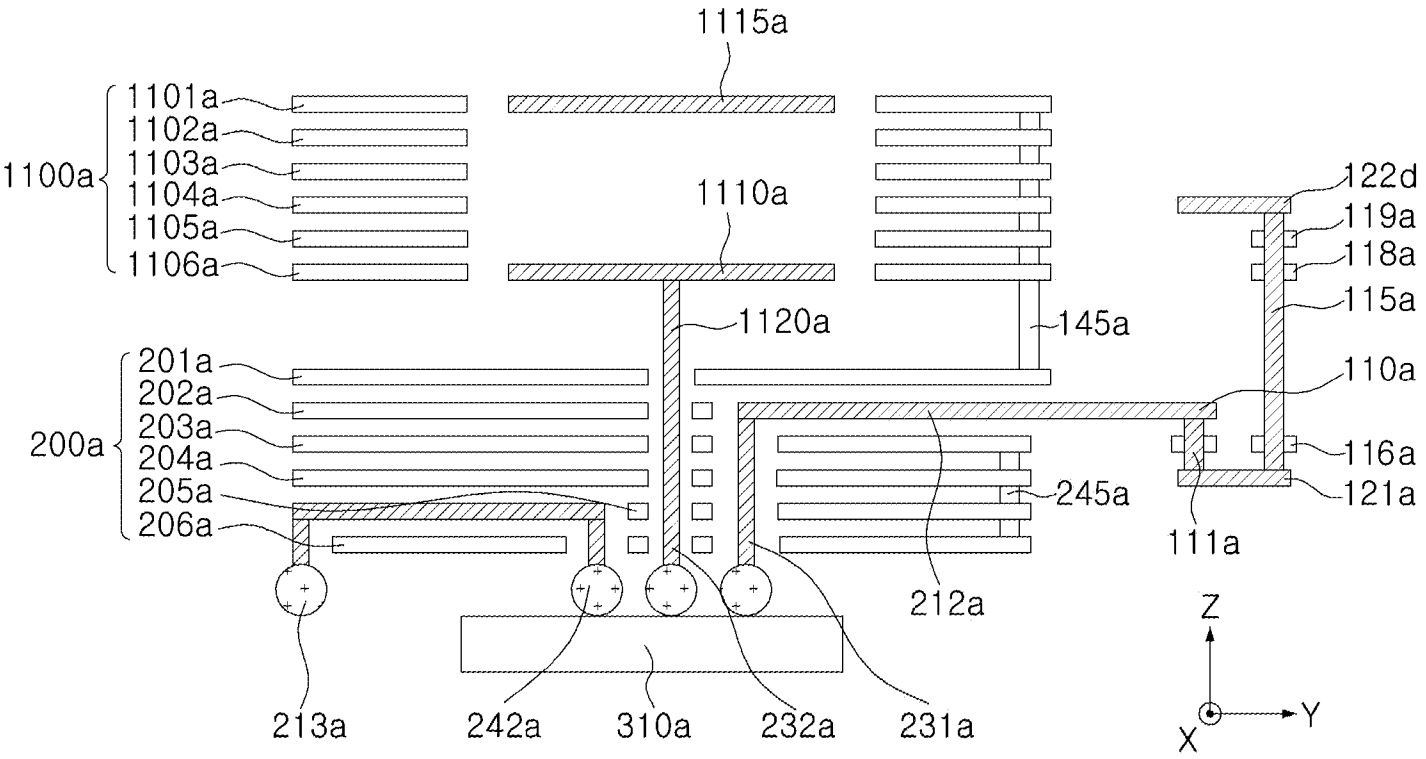
FIG. 2B is a side view illustrating an antenna apparatus according to an example.

FIG. 2A is a perspective view illustrating an antenna apparatus according to an example. FIG. 2B is a side view illustrating an antenna apparatus according to an example.

Referring to FIGS. 2A and 2B, a core via 115*a* may be disposed further forward (in the +Y direction) than a feed via 111*a*.

Figure 2C:
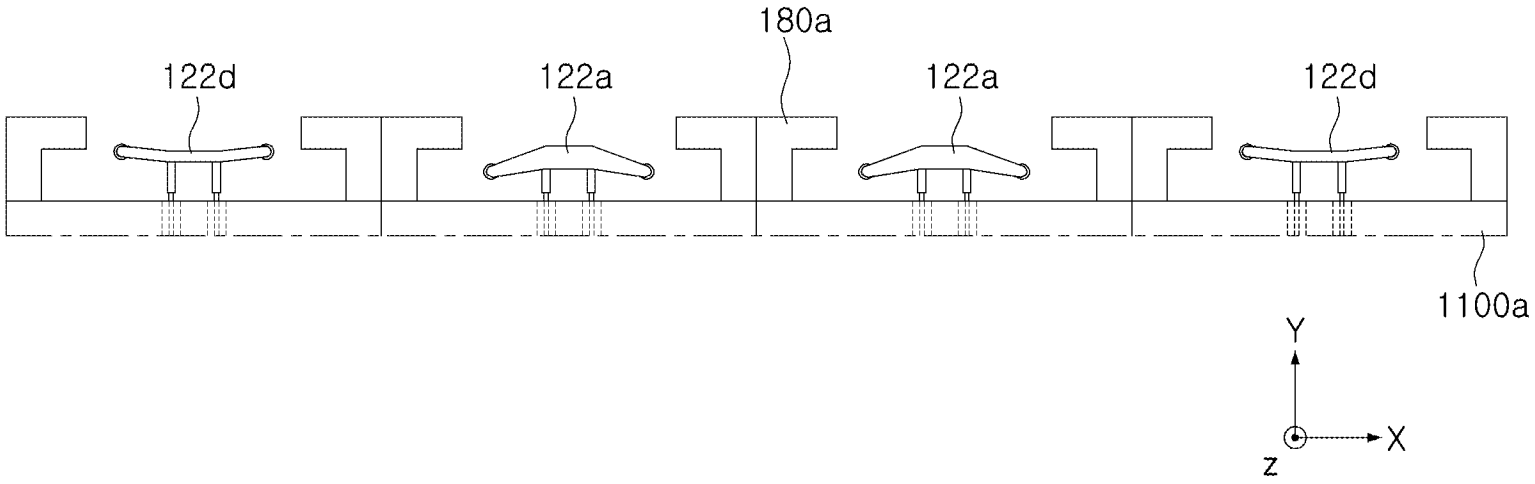
FIG. 2C is a plan view illustrating an arrangement of an antenna apparatus according to an example.

FIG. 2C is a plan view illustrating an arrangement of an antenna apparatus according to an example.

Referring to FIG. 2C, a plurality of second end-fire antenna patterns 122*a* and 122*d* may be arranged in the X direction, and may focus radiation patterns in the Y direction.

The configuration of one of the plurality of second end-fire antenna patterns 122*a* and 122*d* may be different from the configuration of the other.

Figure 3:
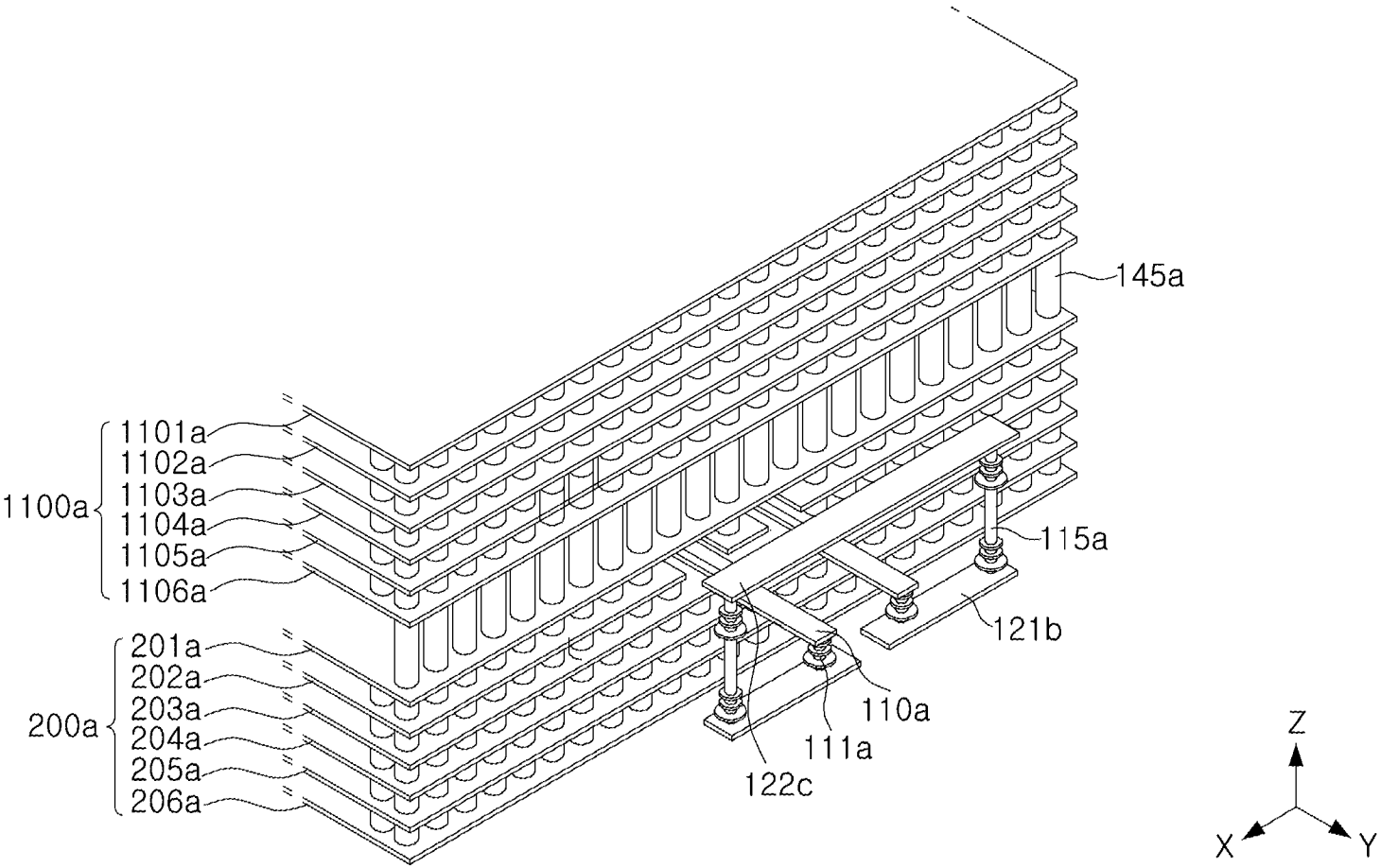
FIG. 3 is a perspective view illustrating an antenna apparatus according to an example.

FIG. 3 is a perspective view illustrating an antenna apparatus according to an example.

Referring to FIG. 3, a first end-fire antenna pattern 121*b* and a second end-fire antenna pattern 122*c* may be configured to be in parallel to a plurality of ground planes 201*a*, 202*a*, 203*a*, 204*a*, 205*a*, and 206*a*.

Figure 4A:
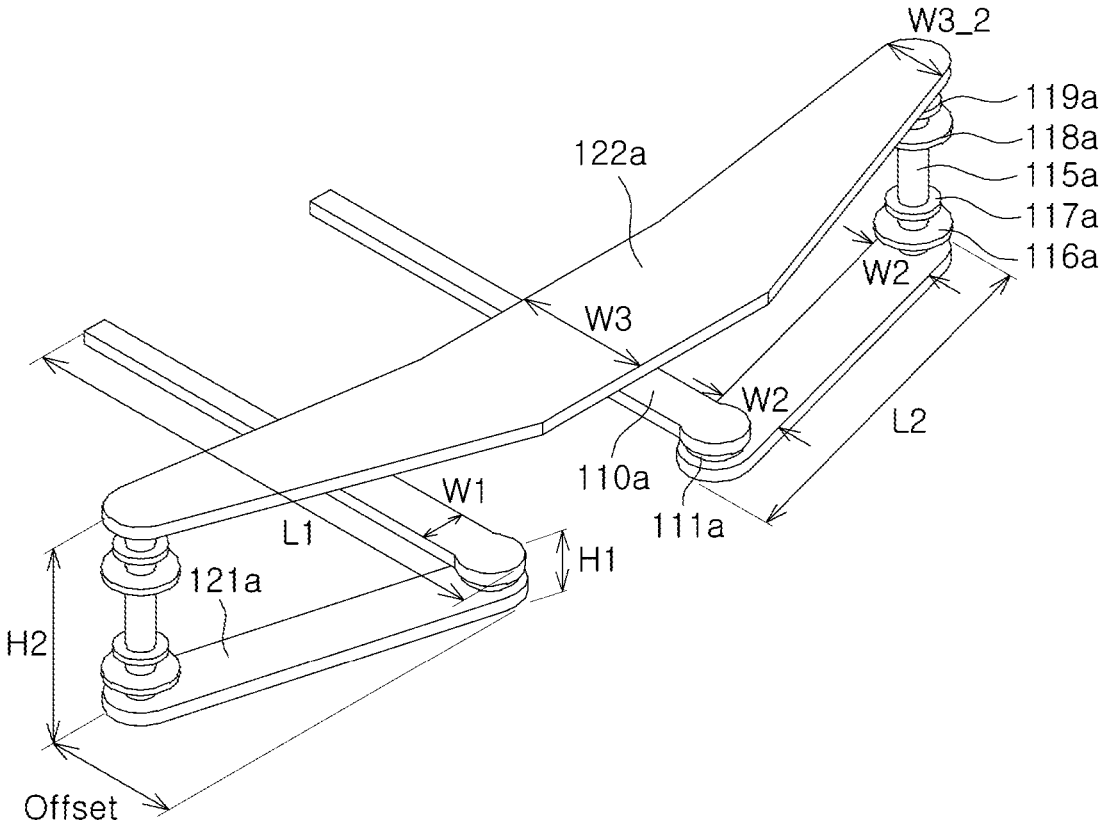
FIGS. 4A and 4B are views illustrating dimensions of an antenna apparatus according to an example.
Figure 4B:
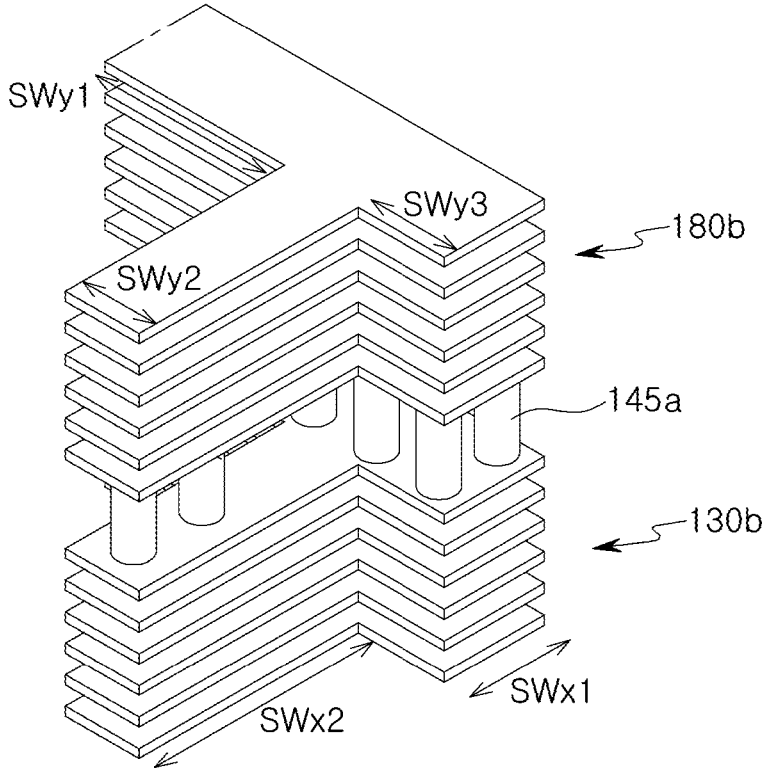

FIGS. 4A and 4B are views illustrating dimensions of an antenna apparatus according to an example.

Referring to FIG. 4A, a first end-fire antenna pattern 121*a* may be configured to extend in a diagonal direction by an offset with respect to a feed line 110*a*.

Accordingly, a second length L2 of the first end-fire antenna pattern 121*a* may be flexibly adjusted by adjusting a direction of the extending portion of the first end-fire antenna pattern 121*a*, extending from the feed line 110*a*. Accordingly, a bandwidth of the first end-fire antenna pattern 121*a* may be flexibly designed.

A deviation between a third width W3 and a 3-2th width W3_2 of a second end-fire antenna pattern 122*a* may be greater than a deviation of a second width W2 of the first end-fire antenna pattern 121*a*.

Accordingly, the first and second end-fire antenna patterns 121*a* and 122*a* may easily have different resonance frequencies, thereby improving gains and/or bandwidths of the first and second end-fire antenna patterns 121*a* and 122*a*.

Also, a spacing distance (H2-H1) between the feed line 110*a* and the second end-fire antenna pattern 122*a* in upwards and downward directions (+/−Z direction) may be longer than a spacing distance H1 between the feed line 110*a* and the first end-fire antenna pattern 121*a* in upwards and downward directions (+/−Z direction).

Accordingly, the spacing distance between the first and second end-fire antenna patterns 121*a* and 122*a* taken in the Z direction may easily be elongated, thereby reducing electromagnetic interference between the first and second RF signals.

Referring to FIG. 4B, each of first and second ground patterns 130*b* and 180*b* may have a first length SWx1 taken in the X direction and a second length SWx2 taken in the X direction, and may have a first length SWy1 taken in the Y direction, a second length SWy2 taken in the Y direction, and a third length SWy3 taken in the Y direction.

The first length SWx1 taken in the X direction and the second length SWx2 taken in the X direction may be configured such that protruding portions of the first and second ground patterns 130*b* and 180*b* may be disposed further forward than the first and second end-fire antenna patterns, but the configuration thereof is not limited thereto.

The second length SWx2 taken in the X direction may be configured such that a front side of at least a portion of the first and second end-fire antenna patterns may not be blocked, but embodiment configuration thereof is not limited thereto.

Figure 5A:
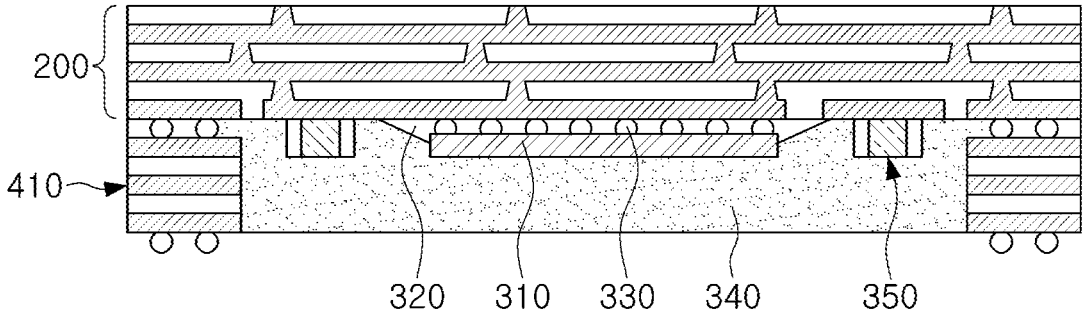
FIGS. 5A and 5B are views illustrating a connection member included in the antenna apparatus illustrated in FIGS. 1A through 4B and a lower structure of the connection member.
Figure 5B:
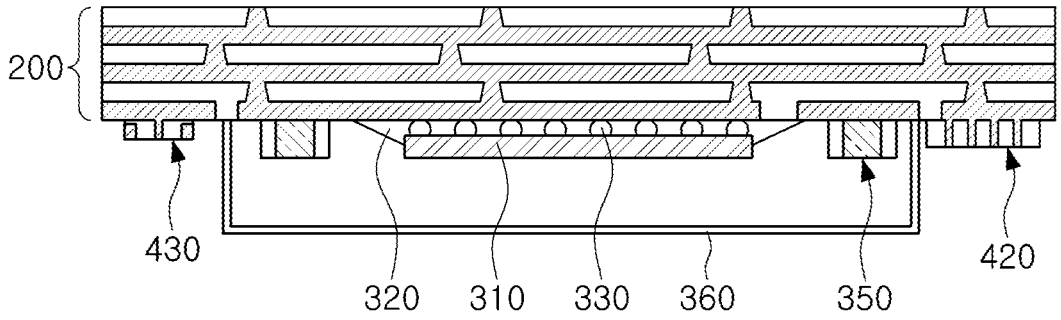

FIGS. 5A and 5B are views illustrating a connection member included in the antenna apparatus illustrated in FIGS. 1A through 4B and a lower structure of the connection member.

Referring to FIG. 5A, an antenna apparatus may include at least portions of a connection member 200, an IC 310, an adhesive member 320, an electrical interconnect structure 330, an encapsulant 340, a passive component 350, and a sub-substrate 410.

The connection member 200 may have a structure similar to a structure of the connection member 200*a* described with reference to FIGS. 1A through 4B.

The IC 310 may be the same as the IC 310*a* described in the aforementioned examples, and may be disposed on a lower side of the connection member 200. The IC 310 may be electrically connected to a wiring line of the connection member 200 and may transmit or receive an RF signal. The IC 310 may also be electrically connected to a ground plane of the connection member 200 and may be provided with ground. For example, the IC 310 may generate a converted signal by performing at least portions of frequency conversion, amplification, filtering, a phase control, and power generation.

The adhesive member 320 may allow the IC 310 and the connection member 200 to be adhered to each other.

The electrical interconnect structure 330 may electrically connect the IC 310 to the connection member 200. For example, the electrical interconnect structure 330 may have a structure such as a solder ball, a pin, a land, a pad, and the like. The electrical interconnect structure 330 may have a melting point lower than melting points of a wiring line and a ground plane of the connection member 200 and may electrically connect the IC 310 and the connection member 200 to each other through a required process using the low melting point.

The encapsulant 340 may encapsulate at least a portion of the IC 310, and may improve a heat dissipation performance and a protection performance against impacts. For example, the encapsulant 340 may be implemented by a photoimageable encapsulant (PIE), an Ajinomoto build-up film (ABF), an epoxy molding compound (EMC), and the like.

The passive component 350 may be disposed on a lower surface of the connection member 200, and may be electrically connected to a wiring line and/or a ground plane of the connection member 200 through the interconnect structure 330.

The sub-substrate 410 may be disposed on a lower surface of the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency (e.g., 24 GHz, 28 GHz, 36 GHz, 39 GHz, 60 GHz) of the RF signal may be greater than a frequency (e.g., 2 GHz, 5 GHz, 10 GHz, and the like) of the IF signal.

For example, the sub-substrate 410 may transmit an IF signal or a baseband signal to the IC 310 through a wiring line included in an IC ground plane of the connection member 200, or may receive the signal from the IC 310. As a first ground plane of the connection member 200 is disposed between the IC ground plane and a wiring line, an IF signal or a baseband signal and an RF signal may be electrically isolated from each other in an antenna module.

Referring to FIG. 5B, the antenna apparatus may include at least portions of a shielding member 360, a connector 420, and a chip antenna 430.

The shielding member 360 may be disposed on a lower side of the connection member 200 and may enclose the IC 310, together with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may have an accommodating space having a hexahedral form by being combined with the connection member 200. The shielding member 360 may be implemented by a material having relatively high conductivity such as copper, such that the shielding member 360 may have a skin depth, and the shielding member 360 may be electrically connected to a ground plane of the connection member 200. Accordingly, the shielding member 360 may reduce electromagnetic noise which the IC 310 and the passive component 350 receive.

The connector 420 may have a connection structure of a cable (e.g., a coaxial cable or a flexible PCB), may be electrically connected to the IC ground plane of the connection member 200, and may work similarly to the above-described sub-substrate 410. Accordingly, the connector 420 may be provided with an IF signal, a baseband signal, and/or power from a cable, or may provide an IF signal and/or a baseband signal to a cable.

The chip antenna 430 may transmit or receive an RF signal in addition to the antenna apparatus. For example, the chip antenna 430 may include a dielectric block having a dielectric constant higher than that of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 6A:
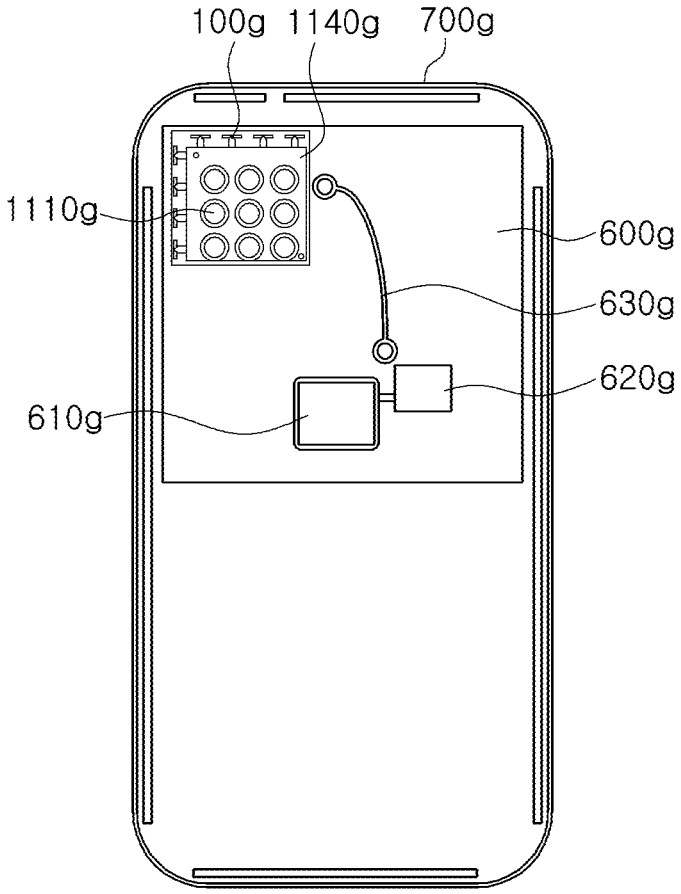
FIGS. 6A and 6B are plan views illustrating an example of an electronic device in which an antenna apparatus is disposed.
Figure 6B:
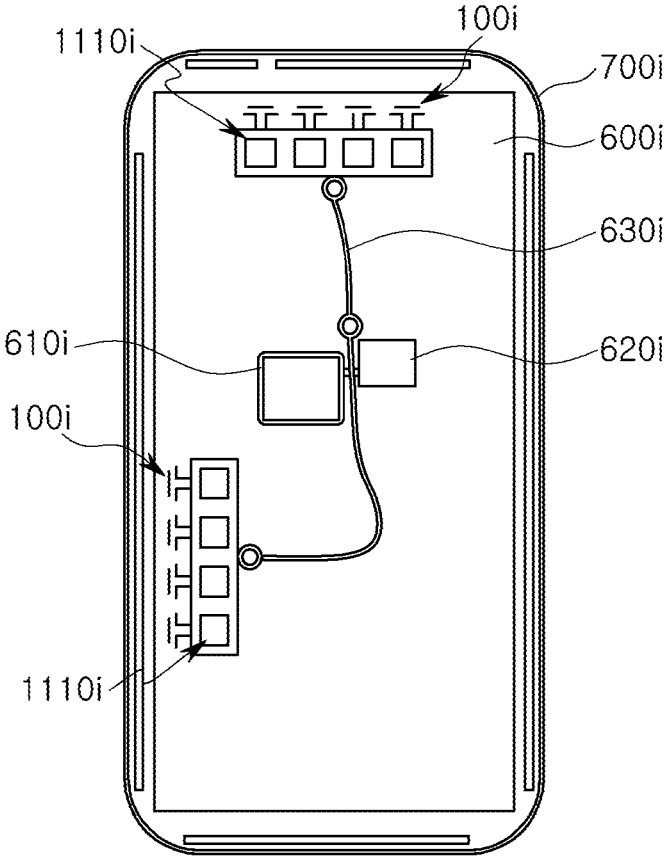

FIGS. 6A and 6B are plan views illustrating an example of an electronic device in which an antenna apparatus is disposed.

Referring to FIG. 6A, an antenna module including an antenna apparatus 100*g*, a patch antenna pattern 1110*g*, and a dielectric layer 1140*g* may be disposed adjacent to a side surface boundary of an electronic device 700*g* on a set substrate 600*g* of the electronic device 700*g*.

The electronic device 700*g* may be implemented as a smartphone, a personal digital assistant, a digital video camera, a digital still camera, a network system, a computer, a monitor, a tablet PC, a laptop PC, a netbook PC, a television, a video game, a smart watch, an Automotive component, or the like, but an example of the electronic device 700*g* is not limited thereto.

A communication module 610*g* and a baseband circuit 620*g* may further be disposed on the set substrate 600*g*. The antenna module may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna module through a cable.

For example, the base signal may be transferred to an IC through an electrical interconnect structure, a cover via, and a wiring line. The IC may cover the base signal into an RF signal of mmWave band.

Referring to FIG. 6B, a plurality of antenna modules each including an antenna apparatus 100*i* and a patch antenna pattern 1110*i* may be disposed adjacent to a center of a side of an electronic device 700*i* having a polygonal shape on a set substrate 600*i* of the electronic device 700*i*, and a communication module 610*i* and a baseband circuit 620*i* may further be disposed on the set substrate 600*i*. The antenna apparatus and the antenna module may be electrically connected to the communication module 610*i* and/or the baseband circuit 620*i* through a coaxial cable 630*i*.

The end-fire antenna pattern, the feed line, the feed via, the core via, the wiring via, the ground plane, the ground pattern, the patch antenna pattern, the shielding via, and the electrical interconnect structure described in the example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The dielectric layer and/or the insulating layer described in the example embodiments may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, prepreg, a Ajinomoto build-up film (ABF), FR-4, bismaleimide triazine (BT), a Photoimagable Dielectric (PID) resin, a general copper clad laminate (CCL), glass or a ceramic-based insulating material, or the like. The dielectric layer and/or the insulating layer may fill at least a portion of a position of the antenna apparatus in which the end-fire antenna pattern, the feed line, the feed via, the core via, the wiring via, the ground plane, the ground pattern, the patch antenna pattern, the shielding via, and the electrical interconnect structure are not disposed.

The RF signal described in the example embodiments may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the abovementioned protocols, but an example embodiment thereof is not limited thereto.

According to the aforementioned example embodiments, the antenna apparatus may provide a transmission and reception means for a plurality of different frequency bands, may improve an antenna performance (e.g., a gain, a bandwidth, directivity, a transmission and reception rate, and the like), and/or may be easily miniaturized.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a feed line;

a ground plane surrounding a portion of the feed line;

a feed via electrically connected to the feed line and extending from a first side of the feed line;

a first end-fire antenna pattern, disposed on a first side of at least a portion of the ground plane and spaced apart from the ground plane, electrically connected to the feed via;

a second end-fire antenna pattern disposed on a second side of the feed line opposite the first side of the feed line and spaced apart from the first end-fire antenna pattern;

a core via electrically connecting the first end-fire antenna pattern to the second end-fire antenna pattern; and a core pattern electrically connected to the core via between the first end-fire antenna pattern and the second end-fire antenna pattern.

2. The antenna apparatus of claim 1, wherein the core via includes a plurality of core vias, and wherein the second end-fire antenna pattern electrically connects the plurality of core vias to each other.

3. The antenna apparatus of claim 1, wherein the core pattern has a width greater than a width of the core via.

4. The antenna apparatus of claim 1, further comprising:

a plurality of first ground patterns extending from at least a portion of the ground plane such that the first end-fire antenna pattern and the second end-fire antenna pattern are disposed between the plurality of first ground patterns and the ground plane, and the plurality of first ground patterns comprises first protruding portions protruding towards each other.

5. The antenna apparatus of claim 4, wherein the core via is disposed more adjacent to the plurality of first ground patterns than to the feed via.

6. The antenna apparatus of claim 4, further comprising:

a plurality of second ground patterns disposed on a first side of the plurality of first ground patterns and comprising second protruding portions protruding towards each other; and a plurality of first shielding vias electrically connecting the first protruding portions to the second protruding portions.

7. The antenna apparatus of claim 1, wherein the first end-fire antenna pattern extends diagonally with respect to the feed line.

8. The antenna apparatus of claim 7, wherein a deviation of a width of the second end-fire antenna pattern is greater than a deviation of a width of the first end-fire antenna pattern.

9. The antenna apparatus of claim 1, wherein a spacing distance between the feed line and the second end-fire antenna pattern is larger than a spacing distance between the feed line and the first end-fire antenna pattern.

10. The antenna apparatus of claim 1, further comprising:

a patch antenna pattern disposed on the second side of the feed line farther away from the feed line than the ground plane, wherein at least a portion of the second end-fire antenna pattern is disposed at a same distance or farther away from the feed line than the patch antenna pattern.

11. An antenna apparatus, comprising:

a feed line;

a ground plane surrounding at least a portion of the feed line;

a first end-fire antenna pattern disposed on a first side of the ground plane, spaced apart from the ground plane, and electrically connected to the feed line;

a second end-fire antenna pattern disposed on an opposite side of the feed line from the first end-fire antenna pattern and spaced apart from the first end-fire antenna pattern;

a core via electrically connecting the first end-fire antenna pattern to the second end-fire antenna pattern; and a plurality of first ground patterns extending from at least a portion of the ground plane such that the first end-fire antenna pattern and the second end-fire antenna pattern are disposed between the plurality of first ground patterns and the ground plane, and the plurality of first ground patterns comprises first protruding portions protruding towards each other.

12. The antenna apparatus of claim 11, further comprising:

a plurality of second ground patterns disposed on a first side of the plurality of first ground patterns and comprising second protruding portions protruding towards each other; and a plurality of first shielding vias electrically connecting the first protruding portions to the second protruding portions.

13. The antenna apparatus of claim 12, further comprising:

a plurality of second shielding vias, at least a portion of which is disposed in between the first and second end-fire antenna patterns and the ground plane, and extending from the ground plane away from the feed line.

14. The antenna apparatus of claim 12, wherein the first end-fire antenna pattern is disposed at a same distance or farther away from the feed line than at least a portion of the plurality of first ground patterns, and wherein the second end-fire antenna pattern is disposed at a same distance or farther away from the feed line than at least a portion of the plurality of second ground patterns.

15. The antenna apparatus of claim 11, wherein the first protruding portions protrude towards each other in a region disposed further away from the first side of the ground plane than the first end-fire antenna pattern and the second end-fire antenna pattern, and wherein a spacing distance between the first protruding portions is larger than a length of the second end-fire antenna pattern.

16. The antenna apparatus of claim 11, wherein each of the plurality of first ground patterns is L-shaped or T-shaped.

17. An antenna apparatus, comprising:

a ground plane extending in a first direction;

a feed line extending from the ground plane in a second direction substantially perpendicular to the first direction;

a first end-fire antenna pattern electrically connected to the feed line and disposed on a first side of the feed line spaced apart from the feed line in a third direction substantially perpendicular to the first direction and the second direction;

a second end-fire antenna pattern disposed on a second side of the feed line opposite the first side of the feed line and spaced apart from the feed line in the third direction;

a core via spaced apart from the feed line in the first direction and the second direction and electrically connecting the first end-fire antenna pattern to the second end-fire antenna pattern; and a ground pattern comprising a first portion that extends from the ground plane in the second direction and a second portion that extends from the first portion in the first direction.

18. The antenna apparatus of claim 17, wherein the second portion of the ground pattern is spaced apart from the ground plane in the second direction more than both the first end-fire antenna pattern and the second end-fire antenna pattern.

19. The antenna apparatus of claim 17, wherein a point at which the first end-fire antenna pattern is electrically connected to the feed line is spaced apart from the ground plane in the second direction more than the core via.

20. The antenna apparatus of claim 17, wherein the core via is spaced apart from the ground plane in the second direction more than a point at which the first end-fire antenna pattern is electrically connected to the feed line.

* * * * *